US005779571A

United States Patent [19]

Roggenkamp

[11] Patent Number: 5,779,571

[45] Date of Patent: Jul. 14, 1998

[54] BALL-GAME RACKET, IN PARTICULAR A TENNIS RACKET

[75] Inventor: Karl Heinz Roggenkamp, Euskirchen, Germany

[73] Assignees: Franz Volkl GmbH & Co.; Ski und Tennis Sportartikelfabrik KG, both of Germany

[21] Appl. No.: 820,492

[22] Filed: Mar. 19, 1997

[30] Foreign Application Priority Data

Apr. 3, 1996 [DE] Germany ..... 196 13 347.5
Apr. 10, 1996 [DE] Germany ..... 196 14 247.4

[51] Int. Cl.[6] ..... A63B 49/02

[52] U.S. Cl. ..... 473/519

[58] Field of Search ..... 473/516, 519, 473/520, 521

[56] References Cited

U.S. PATENT DOCUMENTS

| | | | |
|---|---|---|---|
| 3,116,926 | 1/1964 | Owen et al. | 473/519 X |
| 3,907,292 | 9/1975 | Moreland | 473/519 X |
| 3,975,018 | 8/1976 | Walker | 473/519 |
| 4,325,549 | 4/1982 | Vasselli | 473/519 |
| 4,984,792 | 1/1991 | Pacanski | 473/519 |
| 5,174,568 | 12/1992 | You | 473/521 |

*Primary Examiner*—William E. Stoll
*Attorney, Agent, or Firm*—Bierman, Muserlian and Lucas

[57] ABSTRACT

A ball-game racket, in particular a tennis racket, having a racket head consisting of a tension frame and netting and having a shaft (6) with handle extending away from the racket head, has at least one spring-mass system which is provided on one side of a midplane enclosing the longitudinal axis of the shaft and arranged perpendicular to the plane of the netting and has, in a movement channel extending from the handle into the racket head, at least one mass weight which is movable in the longitudinal direction of the channel against the action of a spring element between a starting position in the handle and an end position in the racket head.

15 Claims, 3 Drawing Sheets

BALL-GAME RACKET, IN PARTICULAR A TENNIS RACKET

BACKGROUND OF THE INVENTION

1. Field of the Invention

The invention relates to a ball-game racket, in particular a tennis racket, as well as to a spring-mass system for such a racket.

2. Description of Related Art

Ball-game rackets having spring-mass systems integrated in the racket, i.e., not visible from the outside and accommodated protected by the racket, are known in principle (DE 32 18 854 A1). The object of the invention is to indicate a ball-game racket which ensures improved play behavior as compared with known rackets of this type.

BRIEF SUMMARY OF THE INVENTION

To accomplish this object, a ball-game racket, in particular a tennis racket, has

- a racket head, which consists of a tension frame for the netting,
- a shaft with handle extending away from the racket head, as well as
- at least one spring-mass system, which is provided on one side of a midplane enclosing the longitudinal axis of the shaft and arranged perpendicular to the plane of the netting and, in a movement channel extending from the handle into the racket head, has at least one mass weight, movable in the longitudinal direction of the channel, which is movable against the action of a spring element serving as a restoring spring between a starting position in the handle and an end position in the racket head,
- where the mass weight consists of a plurality of mass elements joined together like a string of pearls by way of a connecting element, the movement channel being formed of the channel of an outer hose that is arranged in a channel-like cavity of the shaft and of the racket head or tension frame, and
- where the mass elements of each mass weight are enclosed by an inner fabric hose, which latter slides with the mass members in the outer hose.

A spring-mass system which (spring-mass system) for a ball-game racket, in particular a tennis racket, having a racket head which consists of a tension frame for the netting, and having a shaft with a handle extending away from the racket head, and which (spring-mass system) is designed for arrangement or attachment in the racket frame, specifically on one side of a midplane enclosing the longitudinal axis of the shaft and arranged perpendicular to the plane of the netting, has

- in a movement channel extending from the handle into the racket head, has a mass weight movable in the longitudinal direction of the channel which is movable against the action of a spring element serving as restoring spring between a starting position in the handle and an end position in the racket head,
- where the mass weight consists of a plurality of mass elements joined together like a string of pearls by way of a connecting element, the movement channel being formed of the channel of an outer hose which is arranged in a channel-like cavity of the shaft and of the racket head or tension frame, and
- where the mass elements of each mass weight are enclosed by an inner fabric hose which latter slides with the mass bodies in the outer hose.

In the ball-game racket according to the invention the channel or movement chamber for the mass weight is formed of the inner space of a hose. In addition, the mass weight is formed of a mass band, which not only has a plurality of mass elements, joined by a bandlike or filamentary connecting element, but in which these mass elements are accommodated in an inner fabric hose, so that satisfactory and easy sliding of the mass bands in the channel of the outer hose is ensured.

These spring-mass systems can easily be mounted in the ball-game racket according to the invention, specifically by pushing the outer hose of each one into the cavity of the racket. The spring-mass systems are accommodated in the closed racket frame, i.e., in the shaft and in the tension frame of the racket, completely invisible from the outside. Refinements of the invention are the subject matter of dependent claims.

The invention is described in detail below by examples, with the aid of the figures, wherein:

DETAILED DESCRIPTION OF THE INVENTION

Figure 1:
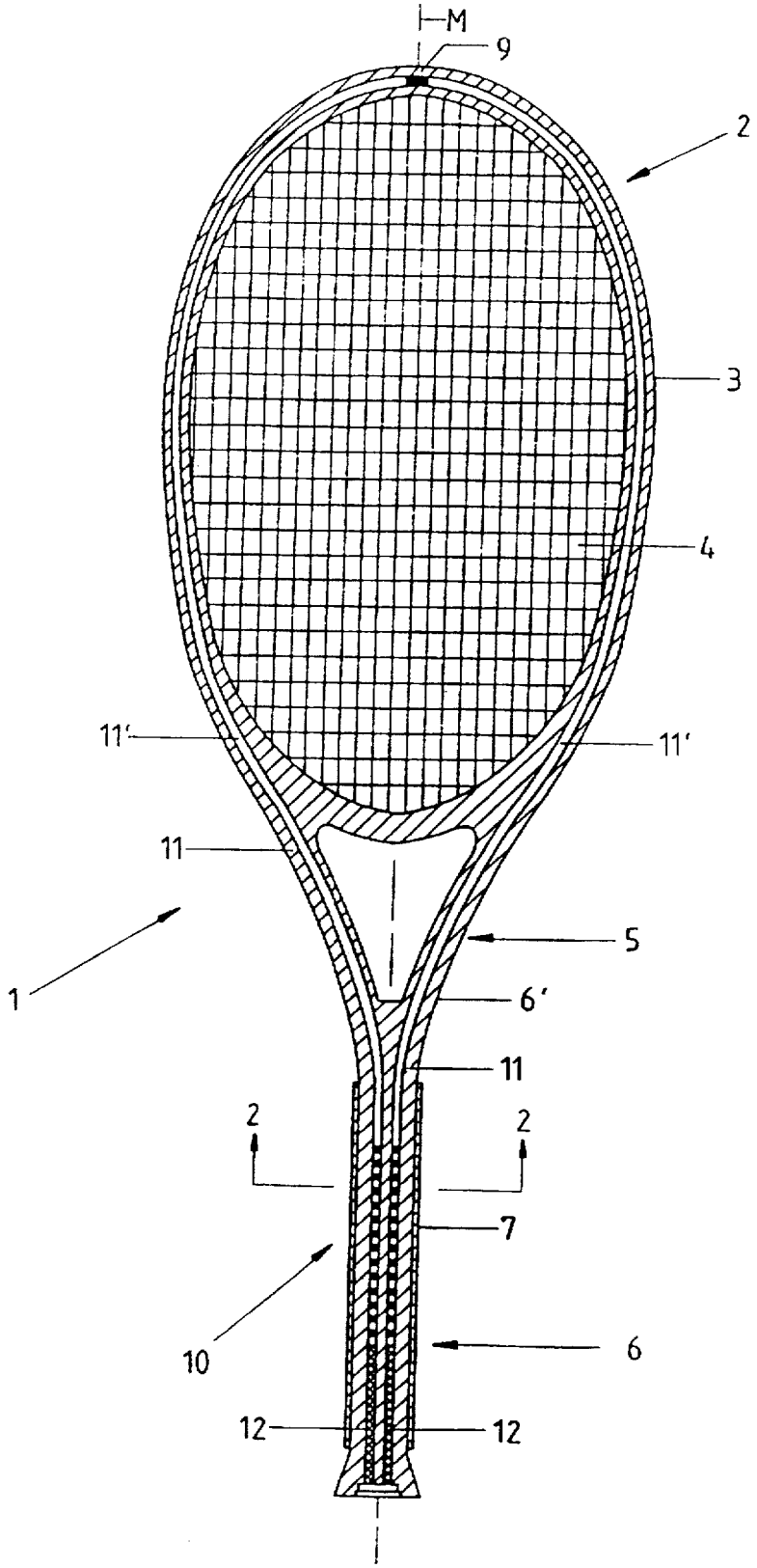
FIG. 1 shows, in simplified representation and in top view as well as partially in section, a ball-game racket in the form of a tennis racket.
Figure 3:
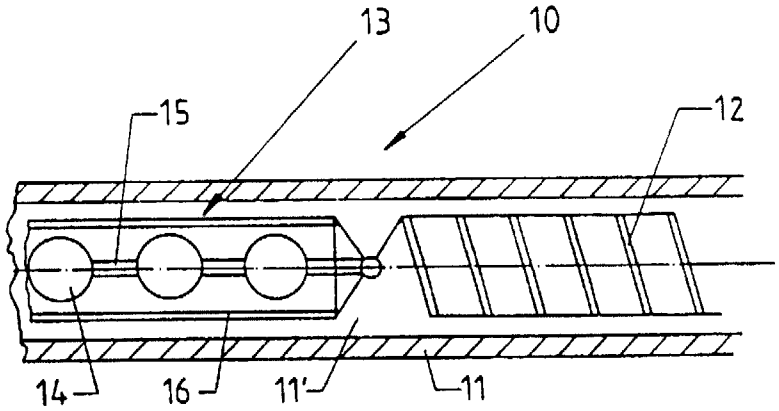
FIG. 3, in simplified schematic partial representation, one of the movement channels in the region of the handle with a partial length of the mass weight provided there.
Figure 2:
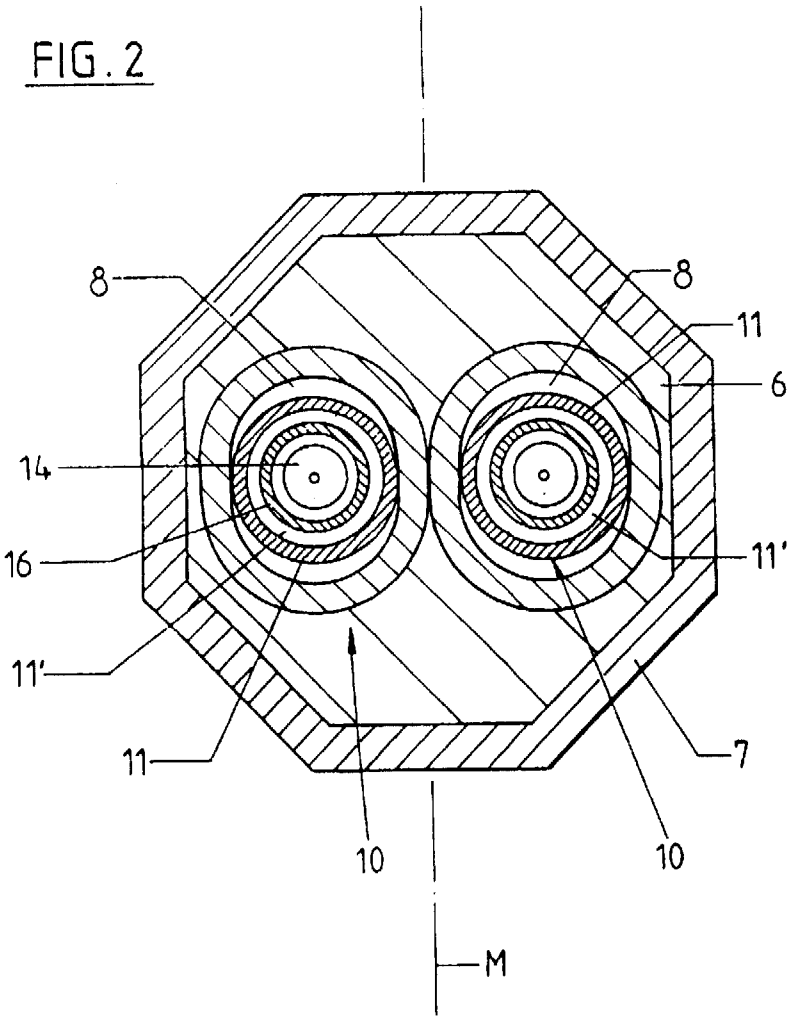
FIG. 2, in enlarged representation, a section through the handle corresponding to the line 2—2 of FIG. 1.

The ball-game racket 1 represented in FIGS. 1–3 consists, in the usual fashion, of a racket head 2 with tension frame 3 and the netting 4 provided there, as well as of the shaft 6, joining the tension frame 3 by way of the core-shaped shaft portion 5, which shaft forms the handle part of the racket 1, and on which the handle 7 is provided. The tension frame 3, the shaft 6 and the shaft sections 6' forming the core-shaped shaft portion 5 form a cavity closed from the outside, specifically of a kind such that two channels 8 are produced which, starting from the free end of the shaft 6 lying distant from the tension frame 3, in each instance extend along a half of the tension frame 3 all the way to the end of the tension frame 3 diametrically opposite the shaft 6 to a point 9 there. In the embodiment represented the racket 1 is designed, with respect to said channels 8 as well, mirror-symmetrical to a midplane M intersecting the netting 4 and enclosing the longitudinal axis of the shaft 6.

In each channel 8 there is provided a spring-mass system 10, which accordingly extends from the free end all the way to the point 9 of the tension frame 3 or the racket head 2. Each spring-mass system 10 consists of an outer hose 11, which although flexible, has a sufficiently high strength so that the hose 11 has the full inside hose diameter over its entire length and is not buckled or crimped at any point. The hose 11 of each spring-mass system 10 extends from the shaft section 6' all the way to the point 9 and is closed off at either end by a suitable closure element. In the movement channel 11' formed by the hose 11 there is provided a spring forming a spring element 12, one end of which is attached at the handle end of the respective hose 11. The spring element 12 acts as a tension spring and at the same time as a compression spring as well, i.e., the spring element 12 is a coiled tension spring, for example, whose windings are deformed by deliberate overstretching so that neighboring windings are also spaced apart in the longitudinal direction of the spring when the spring is released. In the released state the spring element 12, starting from the shaft end of the hose 11, extends over a partial length of the handle 7. At the other end of the spring element 12 is fastened one end of a mass weight 13, movable in the movement channel 11' of the hose 11 in the longitudinal direction of the hose, the end of the weight lying distant from said spring element, with the spring element 12 released, extends to approximately the end of the handle 7 in the direction of the racket head 2 or lies slightly before this end. As FIG. 3 shows especially clearly, the mass weight 13 consists of a plurality of spherical mass elements 1, which consist for example of a metal having a high specific gravity, e.g., of lead, and are joined together like a string of pearls by way of a connecting element 15, for example a filament. All mass elements 14 are enclosed by a fabric hose 16 which is made for example of a fiber of synthetic material or a natural fiber reinforced by a fiber of synthetic material by weaving. The fabric hose 16 is closed at both ends. In addition, the end of the fabric hose 16 in the direction of the spring element 12, as well as the connecting element 15, are connected with the spring element 12. The diameter of the mass weight 13 is selected so that it can slide easily in the movement channel 11' in longitudinal direction. The fabric hose 16 substantially improves sliding ability and prevents the development of noise by the mass weight 13 in the hose 11 (e.g., striking or clicking, etc.). The fabric hose 16 and/or the inner surface of the hose 11 are provided, for instance, with a lubricating agent, for example with talc. The two spring-mass systems 10 are identical and are designed mirror-image to the midplane M.

The spring constants of the springs working as tension springs and the mass of the mass weight 13 are in each instance adjusted so that, as a function of the intensity of motion of the racket 1 in playing, the respective mass weight 13 in the associated hose 11 moves against the action of the spring element 12 out of the region of the handle into the shaft sections 6' or into the tension frame 3 or racket head 2, specifically at most up to the point 9. When a ball strikes the netting 4, according to the physical law of conservation of momentum a moment is produced counteracting the striking force or the slowing of motion of the racket 1, due to which the return-stroke forces unavoidably transmitted to the handle 7 in a racket 1 without spring-mass systems 10 upon hitting the ball are eliminated and the player's tendons and muscles, among other things, are thereby relieved.

After hitting and upon ending of the motion of the racket 1 the mass weights 13 are again moved back into the starting position by the spring elements 12, when the spring elements 12, owing to their compression spring action, then gently capture the returning mass weights 13, so that no vibration develops in the handle 7. In said starting position the mass weights 13 are then located in the handle 7 again.

Another advantage of the racket 1 consists in that the two spring-mass systems 10 can be assembled by simply pushing the hose 11 into the frame of the racket 1.

The racket 1 is designed so that the mass weights 13 and the associated spring elements 12 can be removed by removing a mounting or the closure at the free end of the shaft 6. In the simplest case, said closure is made of a U-shaped clamp (not shown), to which is attached the end of the respective spring element 12 lying distant from the mass weight 13. This provides for the possibility of replacing the unit made up of the mass weight 13 and the spring element 12 and thereby adjusting the racket 1 to each particular type of player.

Figure 4:
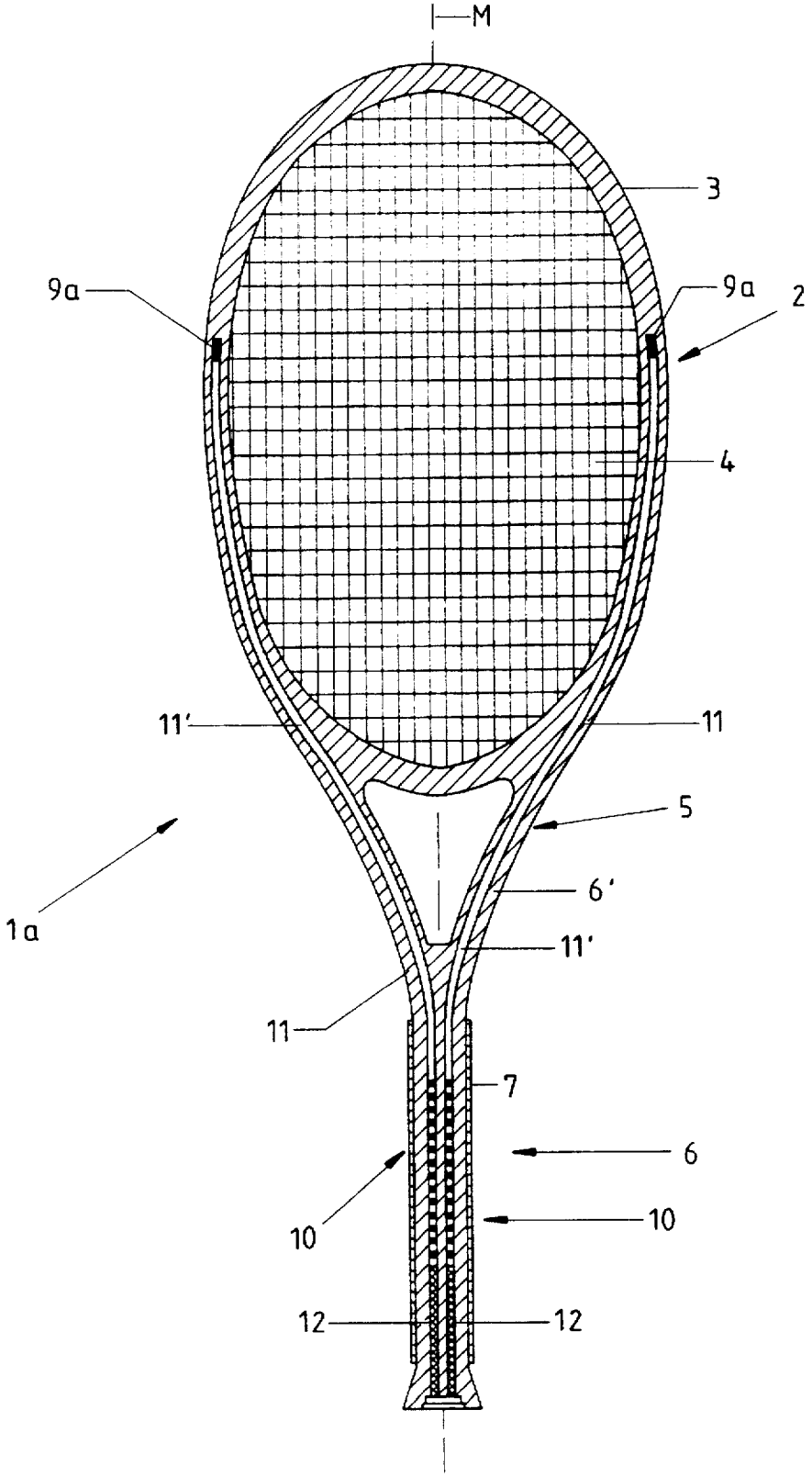
FIG. 4, in a representation similar to that of FIG. 1, another possible embodiment.

As an additional possible embodiment, FIG. 4 shows a ball-game racket 1*a*, which differs from the racket 1 essentially only in that the two spring-mass systems 10*a* do not extend all the way to the point 9 but end at a point 9*a* approximately above the midpoint of the netting 4 on the sides of the racket head 2. In principle, the racket 1*a* likewise has the advantages mentioned above.

Instead of the spring elements 12 designed as coiled springs, rubber bands may alternatively be used.

In addition, it is alternatively possible to install the two hoses 11 in the tension frame 3, in the shaft 6 and in the shaft section 6' forming the core at the time of manufacture of the racket 1 or 1*a*. Then the spring element 12 and associated mass weights 13 are in each instance inserted upon completion of the racket 1 or 1*a*, for example before delivery of the racket 1 or 1*a* to the dealer, or else not until reaching the dealer, in this case then, for example, so that the units in each instance made up of a mass weight 13 and a spring element 12 are selected to fit the particular type of player, and assembled.

List of Reference Numerals

1, 1*a* Tennis racket
2 Racket head
3 Tension frame
4 Netting
5 Core
6 Shaft
7 Handle
8 Channel
9, 9*a* End
10 Mass-spring system
11 Hose
12 Spring
13 Mass band
14 Mass element
15 Filamentary connecting element
16 Fabric hose

I claim:

1. A ball-game racket having a racket head (2) consisting of a tension frame (3) for the netting (4), having a shaft (6) extending away from the racket head (2), and having at least one spring-mass system (10) which is provided on one side of a midplane (M) enclosing the longitudinal axis of the shaft (6) and arranged perpendicular to the plane of the netting (4) and, in a movement channel (11') extending from the handle (7) into the racket head (2), at least one mass weight (13), movable in the longitudinal direction of the channel, which is movable against the action of a spring element (12) serving as a restoring spring between a starting position in the handle (7) and an end position in the racket head (2), where the mass weight (13) consists of a plurality of mass elements (14) joined together like a string of pearls by way of a connecting element (15), characterized in that the movement channel (11') is formed by the channel of an outer hose (11) which is arranged in a channel-like cavity of the shaft (6) and of the racket head (2) or the tension frame (3), and in that the mass elements (14) of each mass weight (13) are surrounded by an inner fabric hose (16) which latter slides with the mass elements (14) in the outer hose (11).

2. The ball-game racket according to claim 1, characterized in that at least one spring-mass system (10) is provided on both sides of the midplane (M) in each instance.

3. The ball-game racket according to claim 1, characterized in that at least one spring-mass system (10) extends from the free end of the shaft (6) all the way to a point (9) of the tension frame (3) opposite said shaft (6).

4. The ball-game racket according to claim 1, characterized in that at least one spring-mass system (10) extends from the free end of the shaft (6) all the way to a point (9*a*) on one side of the tension frame (3).

5. The ball-game racket according to claim 1, characterized in that the inner surface of the outer hose (11) and/or the inner fabric hose (16) of the respective mass weight (13) is provided with a lubricating agent, for example with talc.

6. The ball-game racket according a claim 1, characterized in that the respective spring element (12) acts as a tension spring as well as a compression spring.

7. The ball-game racket according to claim 1, characterized in that the respective spring element (12) is made of a single coiled spring.

8. The ball-game racket according to claim 1, characterized in that the hose (11) is pushed into the channel-like cavity of the shaft (6) and of the racket head (2) or tension frame (3).

9. The ball-game racket according to claim 1, characterized in that said at least one spring-mass system (1) is inserted into the racket (1, 1*a*) as a complete structural unit.

10. The ball-game racket according to claim 1, characterized in that the outer hose (11) of the spring-mass system (1)) is in each instance installed in the frame of the racket (1, 1*a*) at the time of manufacture.

11. A spring-mass system for a ball-game racket, the racket having a racket head (2) consisting of a tension frame (3) for the netting (4), and having a shaft (6) with a handle (7) extending away from the racket head (2), where the spring-mass system (10), which is designed for arrangement in the racket frame on one side of a midplane (M) enclosing the longitudinal axis of the shaft (6) and arranged perpendicular to the plane of the netting (4), has in a movement channel (11') extending from the handle (7) into the racket head (2) at least one mass weight (13), movable in the longitudinal direction of the channel, which is movable against the action of a spring element (12) serving as a restoring spring between a starting position in the handle (7) and an end position in the racket head (2), where the mass weight (13) consists of a plurality of mass elements (14) joined together like a string of pearls by way of a connecting element (15), characterized in that the movement channel (11') is formed by the channel of an outer hose (11) which is capable of being pushed into a channel-like cavity of the shaft (6) and of the racket head (2) or the tension frame (3), and in that the mass elements (14) of each mass weight (13) are enclosed by an inner fabric hose (16), which latter slides with the mass elements (14) in the outer hose (11).

12. The spring-mass system according to claim 11, characterized in that the spring-mass system (10) is a complete structural unit capable of insertion into the ball-game racket (1, 1*a*).

13. The spring-mass system according to claim 11, characterized in that the inner surface of the outer hose (11) and/or the inner fabric hose (16) of the respective mass weight (13) is provided with a lubricating agent, for example with talc.

14. The spring-mass system according to claim 11, characterized in that the respective spring element (12) acts as a tension spring as well as a compression spring.

15. The spring-mass system according to claim 11, characterized in that the respective spring element (12) is made of a single coiled spring.

* * * * *